US010621901B2

(12) United States Patent
Hsu et al.

(10) Patent No.: US 10,621,901 B2
(45) Date of Patent: Apr. 14, 2020

(54) DISPLAY PANEL, DISPLAY DRIVER AND METHOD OF DRIVING SUBPIXEL OF DISPLAY PANEL

(71) Applicant: NOVATEK Microelectronics Corp., Hsin-Chu (TW)

(72) Inventors: Chin-Hung Hsu, Taoyuan (TW); Te-Hsien Kuo, Keelung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 63 days.

(21) Appl. No.: 15/939,316

(22) Filed: Mar. 29, 2018

(65) Prior Publication Data

US 2019/0156725 A1 May 23, 2019

Related U.S. Application Data

(60) Provisional application No. 62/588,418, filed on Nov. 19, 2017.

(51) Int. Cl.

| | |
|---|---|
| ***G09G 3/20*** | (2006.01) |
| ***G09G 3/3266*** | (2016.01) |
| ***G09G 3/3275*** | (2016.01) |
| ***G09G 3/36*** | (2006.01) |

(52) U.S. Cl.

CPC ..... *G09G 3/2003* (2013.01); *G09G 3/2092* (2013.01); *G09G 3/3266* (2013.01); *G09G 3/3275* (2013.01); *G09G 3/3674* (2013.01); *G09G 3/3685* (2013.01); *G09G 2300/0426* (2013.01); *G09G 2310/0289* (2013.01); *G09G 2310/0297* (2013.01); *G09G 2320/0242* (2013.01); *G09G 2330/02* (2013.01); *G09G 2330/021* (2013.01); *G09G 2330/023* (2013.01)

(58) Field of Classification Search

CPC .. G09G 3/2003; G09G 3/3674; G09G 3/3685; G09G 3/3275; G09G 3/3266; G09G 3/2092; G09G 2330/02; G09G 2330/021; G09G 2330/023; G09G 2300/0426; G09G 2320/0242; G09G 2310/0289; G09G 2310/0297

See application file for complete search history.

(56) References Cited

U.S. PATENT DOCUMENTS

2008/0165112 A1* 7/2008 Su ..... G09G 3/3677 345/100
2008/0246720 A1* 10/2008 Lee ..... G02F 1/133555 345/96
2009/0278779 A1* 11/2009 Liu ..... G09G 3/3688 345/98
2012/0019500 A1* 1/2012 Hwang ..... G09G 3/3233 345/211
2012/0313903 A1* 12/2012 Pyon ..... G09G 3/32 345/204
2016/0148556 A1* 5/2016 Tseng ..... G09G 3/3677 345/55
2017/0263170 A1* 9/2017 Mu ..... G09G 3/3614

* cited by examiner

*Primary Examiner* — Brent D Castiaux
(74) *Attorney, Agent, or Firm* — Winston Hsu

(57) ABSTRACT

A display panel includes a plurality of data lines, a plurality of scan lines, a plurality of subpixels and a plurality of first demultiplexers. Each of the plurality of subpixels is coupled to at least two of the plurality of data lines and at least two of the plurality of scan lines. Each of the plurality of first demultiplexers is coupled to at least two of the plurality of scan lines.

16 Claims, 14 Drawing Sheets

DISPLAY PANEL, DISPLAY DRIVER AND METHOD OF DRIVING SUBPIXEL OF DISPLAY PANEL

CROSS REFERENCE TO RELATED APPLICATIONS

This application claims the benefit of U.S. Provisional Application No. 62/588,418, filed on Nov. 19, 2017, the contents of which are incorporated herein by reference.

BACKGROUND OF THE INVENTION

1. Field of the Invention

The present invention relates to a display panel, and more particularly, to a display panel with selectable scan lines and data lines.

2. Description of the Prior Art

With development of display technology, a modern display panel tends to have a larger size and higher resolution; hence, the display panel requires significant power consumption for charging its data lines, especially when a heavy-load image is displayed. With a higher resolution and higher frame rate of the display panel, the period for charging data lines becomes shorter, such that the charging time may not be enough to charge a data line to a target level.

Please refer to FIG. 1, which is a schematic diagram of a conventional display system 10. The display system 10 includes a gate driver 102, a source driver 104, a display panel 106 and a timing controller 108. The gate driver 102 and the source driver 104 transmit scan signals and display data to the display panel 106, respectively. The display panel 106 includes a plurality of pixels arranged as an array. Each pixel includes three subpixels with red (R), green (G) and blue (B) colors. The timing controller 108 controls the operations of the gate driver 102 and the source driver 104, for displaying images on the display panel 106.

As shown in FIG. 1, each subpixel receives display data from the source driver 104 via one data line with control of the gate driver 102 via one scan line. In the display system 10, most power consumption is generated from the display panel 106, where the display data with different voltage levels charge or discharge the data lines in each display cycle, which requires significant power. Each data line is coupled to a column of subpixels; hence, there may be a great amount of parasitic capacitance on the data line, especially with large panel and high resolution.

Please refer to FIGS. 2A and 2B, which are waveform diagrams of the data lines in the display panel 106. FIGS. 2A and 2B illustrate a column inversion case, where the data lines in odd columns receive display data with positive polarity and the data lines in even columns receive display data with negative polarity. The voltage VCOM denotes the common voltage of the display panel 106.

FIGS. 2A and 2B illustrate heavy-load image patterns. In detail, FIG. 2A illustrates an H-line pattern, where odd rows of subpixels display the maximum brightness and even rows of subpixels display the minimum brightness. Therefore, each data line receives the highest voltage level and the lowest voltage level of the same polarity alternately. FIG. 2B illustrates a subpixel pattern, where every two adjacent subpixels (along horizontal direction and vertical direction) display the maximum brightness and the minimum brightness, respectively. Therefore, each data line receives the highest voltage level and the lowest voltage level of the same polarity alternately. The operation of charging a data line from the lowest voltage level to the highest voltage level consumes power quantity Q. In these heavy-load image patterns, the source driver 104 should keep charging and discharging each data line, and the data lines are fully charged and discharged between the highest voltage level and the lowest voltage level; hence, the problems of large power consumption and insufficient charging time may easily appear.

Thus, there is a need to provide a display panel and a method of charging the data lines, to reduce power consumption and also allow the data lines to be charged to their target level more easily.

SUMMARY OF THE INVENTION

It is therefore an objective of the present invention to provide a novel structure of a display panel and a related method of driving subpixels of the display panel, to solve the abovementioned problems.

An embodiment of the present invention discloses a display panel, which comprises a plurality of data lines, a plurality of scan lines, a plurality of subpixels and a plurality of first demultiplexers. Each of the plurality of subpixels is coupled to at least two of the plurality of data lines and at least two of the plurality of scan lines. Each of the plurality of first demultiplexers is coupled to at least two of the plurality of scan lines.

Another embodiment of the present invention discloses a source driver for a display system. The source driver comprises a plurality of data output channels. Each data output channel comprises an output buffer, at least two output pads and a demultiplexer. The at least two output pads are coupled to the display panel. The demultiplexer is coupled between the output buffer and the at least two output pads.

Another embodiment of the present invention discloses a method of driving a subpixel of a display panel, where the subpixel is coupled to at least one lines of the display panel having a first line and a second line. The method comprises forwarding a first row data to the first line to display the first row data on the display panel; forwarding a second row data to the second line to display the second row data on the display panel; determining a first variation between a third row data and the first row data and a second variation between the third row data and the second row data, to generate a determination result; and selecting to forward the third row data to the first line or the second line according to the determination result, to display the third row data on the display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
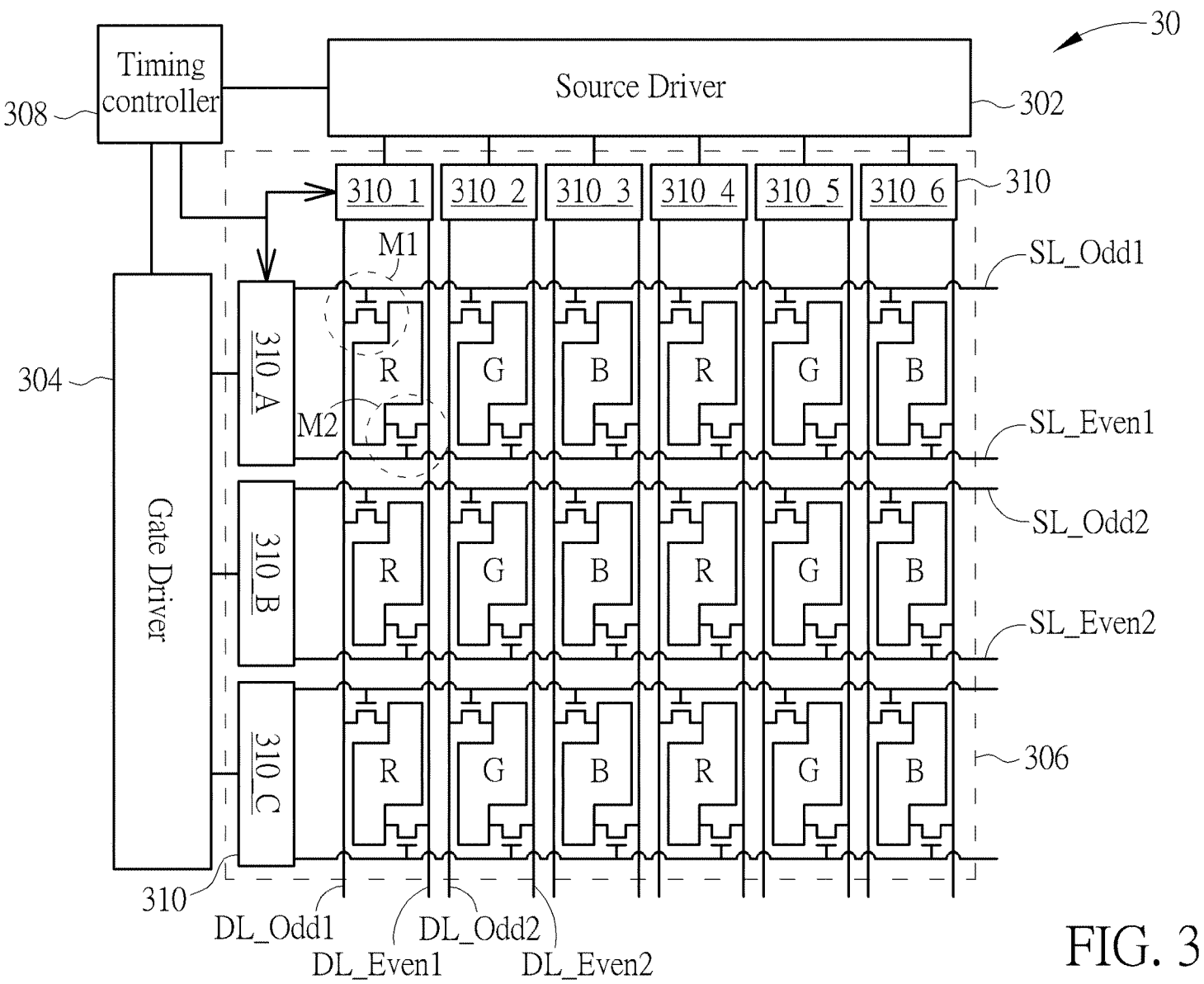
FIG. 3 is a schematic diagram of a display system according to an embodiment of the present invention.

Please refer to FIG. 3, which is a schematic diagram of a display system 30 according to an embodiment of the present invention. As shown in FIG. 3, the display system 30 includes a source driver 302, a gate driver 304, a display panel 306 and a timing controller 308. The display panel 306 includes a plurality of subpixels arranged as an array. Although FIG. 3 merely illustrates 3 rows and 6 columns of subpixels, those skilled in the art should realize that there may be hundreds or thousands of subpixels in the display panel 306. The display panel 306 includes a plurality of data lines, which are coupled to the source driver 302 and receive display data from the source driver 302. More specifically, each subpixel in the display panel 306 is coupled to two data lines, and the source driver 302 transmits a display data to each subpixel via one of the two data lines coupled to the subpixel. The display panel 306 includes a plurality of scan lines, which are coupled to the gate driver 304 and receive scan signals from the gate driver 304. More specifically, each subpixel in the display panel 306 is coupled to two scan lines, and the gate driver 304 transmits a scan signal to each subpixel via one of the two scan lines coupled to the subpixel. The timing controller 308 is coupled to the source driver 302 and the gate driver 304, for controlling the operations of the source driver 302 and the gate driver 304.

In detail, each subpixel includes two transistors (e.g., thin-film transistors (TFTs)), where one transistor is coupled to one of the two data lines corresponding to the subpixel and coupled to one of the two scan lines corresponding to the subpixel, and the other transistor is coupled to the other of the two data lines corresponding to the subpixel and coupled to the other of the two scan lines corresponding to the subpixel. The transistors may receive a voltage signal from a corresponding data line as the display data, where the voltage signal together with the common voltage determines the brightness of the corresponding subpixel. The subpixel may receive the voltage signal of each display data from one of the two transistors.

The source driver 302 is coupled to each column of subpixels via two data lines, and the gate driver 304 is coupled to each row of subpixels via two scan lines. In order to reduce power consumption, the source driver 302 may determine which one of the two data lines may consume less power on data transmission before transmitting a row data, and then transmit the row data via the selected data line. Also, the gate driver 304 selects the corresponding line to transmit a scan signal, to turn on the corresponding transistors for receiving the row data. The display panel 306 further includes a plurality of demultiplexers (DMUXs) 310. Each DMUX 310 is coupled to two data lines corresponding to the same column of subpixels and selects to output display data to one of the two data lines, or coupled to two scan lines corresponding to the same row of subpixels and selects to turn on the transistors corresponding to one of the two scan lines to receive the display data from the selected data lines.

For example, the red subpixel in the first row and the first column is coupled to two data lines DL_Odd1 and DL_Even1. The DMUX 310_1, coupled to these two data lines DL_Odd1 and DL_Even1, may select to forward a display data to one of the data lines DL_Odd1 and DL_Even1. The selection criterion may be, for example, the data line which consumes less power generated by the display data is selected. Note that power consumption is generated if a data line is charged from a lower voltage level to a higher voltage level, where a larger voltage difference requires more power consumption. Therefore, the data line having a voltage level much closer to the level of an upcoming display data may be selected more probably; that is, the upcoming display data may generate less data variation on this selected data line, or the upcoming display data and the present data in the data line have less difference.

In addition, the red subpixel in the first row and the first column is coupled to two scan lines SL_Odd1 and SL_Even1. The DMUX 310_A is coupled to these two scan lines SL_Odd1 and SL_Even1, and may forward a scan signal to one of the scan lines SL_Odd1 and SL_Even1. If the data line DL_Odd1 is selected to forward the display data to the subpixel, the scan signal may be transmitted via the scan line SL_Odd1 correspondingly, and the transistor Ml is turned on to receive the display data. If the data line DL_Even1 is selected to forward the display data to the subpixel, the scan signal may be transmitted via the scan line SL_Even1 correspondingly, and the transistor M2 is turned on to receive the display data.

Figure 4:
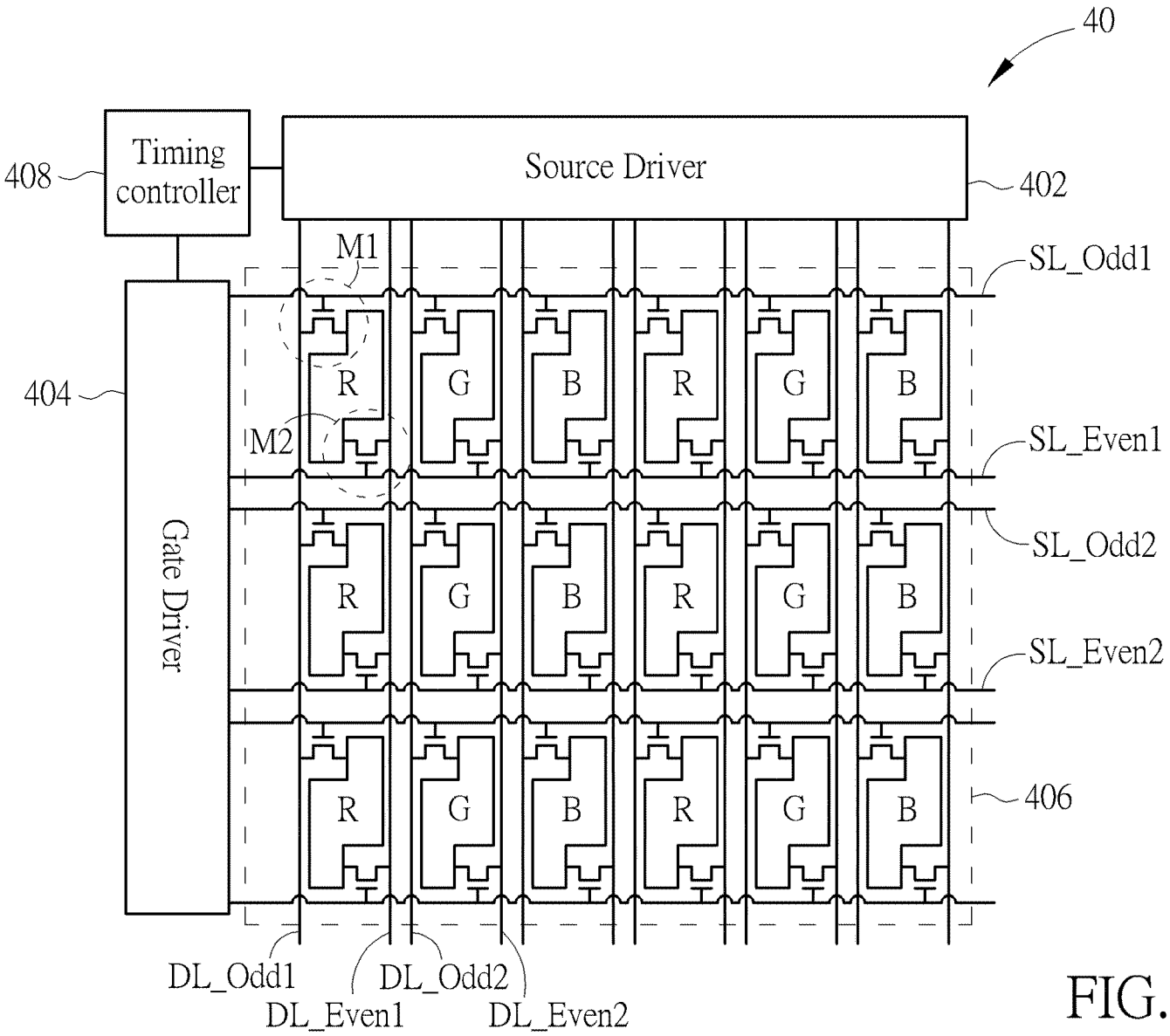
FIG. 4 is a schematic diagram of another display system according to an embodiment of the present invention.

In the embodiment shown in FIG. 3, the DMUXs 310 are implemented in the display panel 306, such as implemented on a glass substrate of the display panel 306 with the touch panel process. In another embodiment, the DMUXs may be included in the source driver and the gate driver. Please refer to FIG. 4, which is a schematic diagram of another display system 40 according to an embodiment of the present invention. As shown in FIG. 4, the display system 40 includes a source driver 402, a gate driver 404, a display panel 406 and a timing controller 408. Without DMUXs in the display panel 406, the two data lines for each column of subpixels are directly coupled to the source driver 402, and the two scan lines for each row of subpixels are directly coupled to the gate driver 404.

Figure 5A:
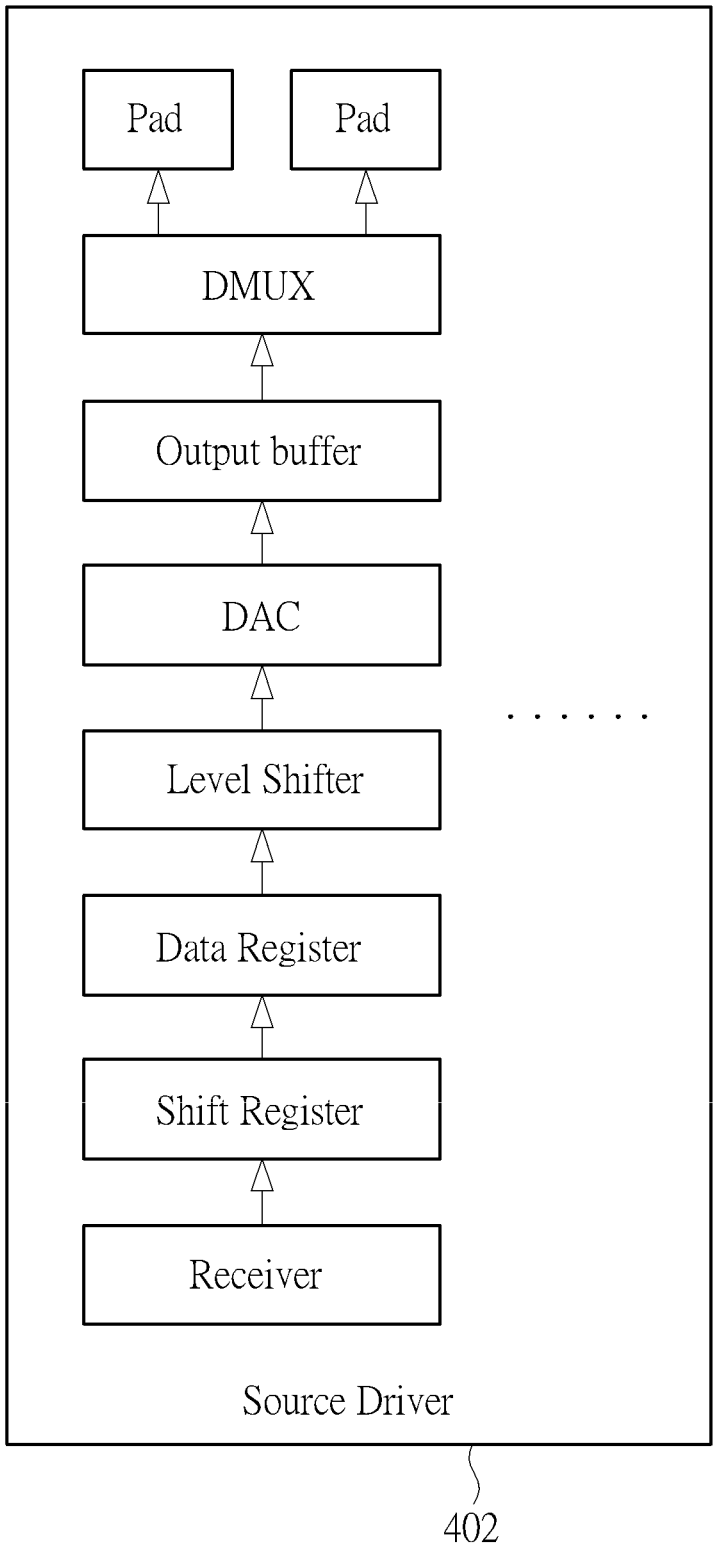
FIG. 5A is a schematic diagram of an exemplary implementation of the source driver shown in FIG. 4.

FIG. 5A illustrates an exemplary implementation of the source driver 402. As shown in FIG. 5A, the source driver 402 includes a plurality of data output channels, each corresponding to a column of subpixels in the display panel 406. Each data output channel includes a receiver, a shift register, a data register, a level shifter, a digital to analog converter (DAC), an output buffer, a DMUX, and two output pads. The receiver and the shift register are coupled to the timing controller 408, for receiving display data and control signals from the timing controller 408. The output pads are coupled to the display panel 406, for outputting the display data to the display panel 406.

In detail, in each data output channel of the source driver 402, the receiver is used for receiving display data from the timing controller 408. The shift register is used for controlling the operations of the data register according to a timing sequence received from the timing controller 408. The data register, which may be implemented with a latch, is used for storing the display data transmitted from the timing controller 408 via a data bus and the receiver, and delivering the display data according to the control of the shift register. The level shifter is used for shifting the voltage level of the display data transmitted from the data register. The DAC then converts the display data in digital form into analog form. The output buffer, which may be implemented with an operational amplifier, is used for transmitting the display data to the DMUX and driving a data line on the display panel 406 to transmit the display data. The DMUX, which is coupled to two data lines on the display panel 406 via two output pads, respectively, may select to forward a display data to one of the output pads, which thereby outputs the display data to the corresponding data line. The operations of the DMUX in the source driver 402 are similar to the operations of the DMUX at the source driver side in the display panel 306 shown in FIG. 3, e.g., the DMUXs 310_1-310_6.

Figure 5B:
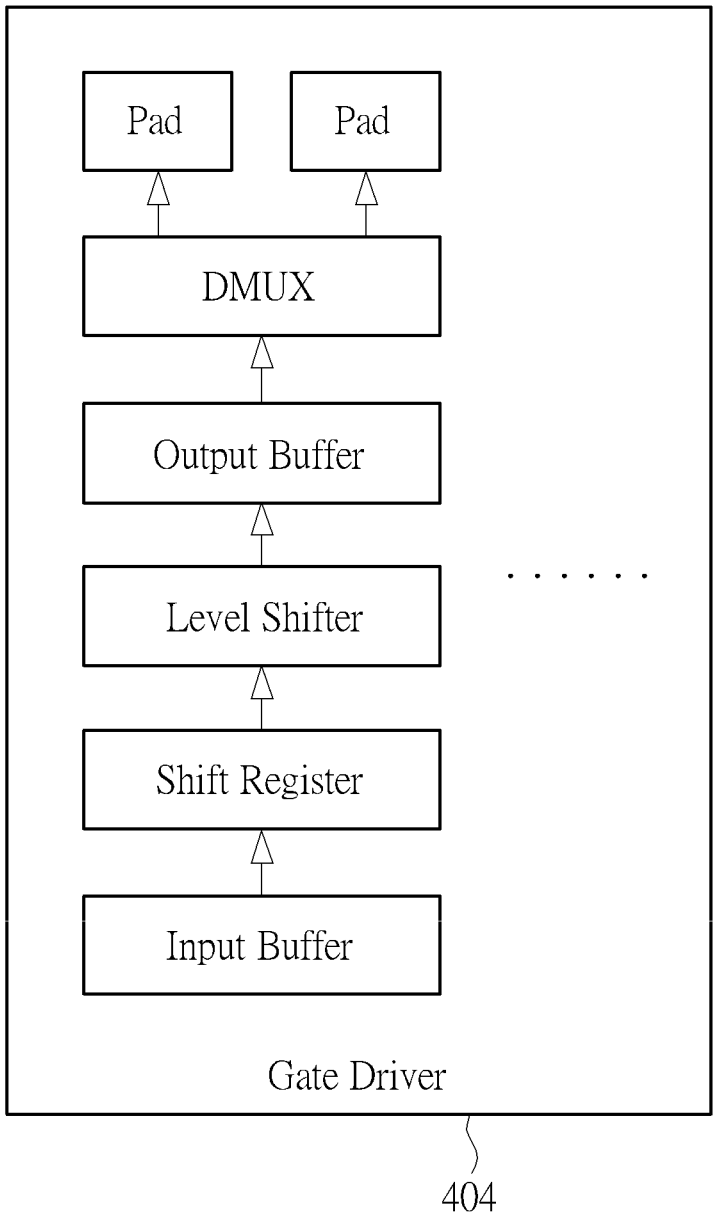
FIG. 5B is a schematic diagram of an exemplary implementation of the gate driver shown in FIG. 4.

FIG. 5B illustrates an exemplary implementation of the gate driver 404. As shown in FIG. 5B, the gate driver 404 includes a plurality of scan channels, each corresponding to a row of subpixels in the display panel 406. Each scan channel includes an input buffer, a shift register, a level shifter, an output buffer, a DMUX, and two output pads. The input buffer and the shift register are coupled to the timing controller 408, for receiving scan signals and control signals from the timing controller 408. The output pads are coupled to the display panel 406, for outputting the scan signals to the display panel 406.

In detail, in the gate driver 404, the input buffer is used for receiving scan signals from the timing controller 408. The shift register is used for controlling the reception of scan signals according to a timing sequence received from the timing controller 408. The level shifter is used for shifting the voltage level of the scans signal transmitted from the timing controller. The output buffer, which may be implemented with an operational amplifier, is used for transmitting the scan signal to the DMUX and driving a scan line on the display panel 406 to transmit the scan signal. The DMUX, which is coupled to two scan lines on the display panel 406 via two output pads, respectively, may select to forward a scan signal to one of the output pads, which thereby outputs the scan signal to the corresponding scan line. The operations of the DMUX in the gate driver 404 are similar to the operations of the DMUX at the gate driver side in the display panel 306 shown in FIG. 3, e.g., the DMUXs 310_A-310_C.

In order to deal with the problem of large power consumption with heavy-load image patterns, the criterion of selecting data lines and scan lines may be performed with frame base. In such a situation, before an image frame is displayed, the timing controller or the driver may determine whether a frame of display data conforms to a particular image pattern such as a heavy-load image pattern. Note that the heavy-load image pattern may be a test pattern, such as an H-line pattern, a subpixel pattern, or any other specific pattern that may generate significant charging and discharging on data lines due to variations of display data in the conventional display panel.

Figure 6A:
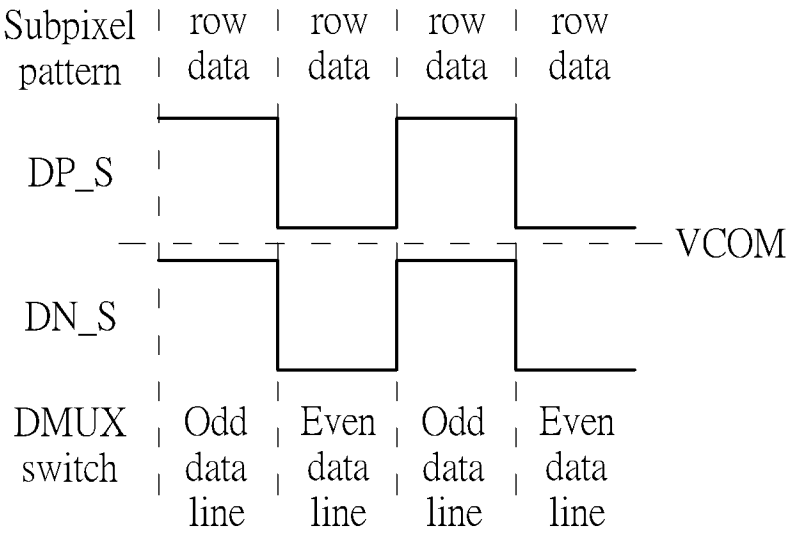
FIG. 6A is a schematic diagram of selection of data lines with display data in the subpixel pattern according to an embodiment of the present invention.

FIG. 6A is a schematic diagram of selection of data lines with display data in the subpixel pattern according to an embodiment of the present invention. In this embodiment, the display panel is driven with column inversion, where display data with positive polarity DP_S and display data with negative polarity DN_S are transmitted to adjacent columns of subpixels. As shown in FIG. 6A, the display data with positive polarity DP_S keeps switched between a high voltage level of positive polarity and a low voltage level of positive polarity, and the display data with negative polarity DN_S keeps switched between a high voltage level of negative polarity and a low voltage level of negative polarity. The voltage VCOM denotes the common voltage of the display panel.

Please refer to FIG. 6A together with the structure of FIGS. 3 and 4, where the subpixel image pattern is displayed in the display system 30 or 40. For the first row data, the display data in both positive polarity and negative polarity are in the high voltage level, and the DMUXs forward the row data to odd data lines, such as the data lines DL_Odd1, DL_Odd2, and other left-side data line of each column of subpixels. Correspondingly, the DMUX 310_A forwards a scan signal to the scan line SL_Odd1 to turn on corresponding transistors to receive the first row data. For the second row data, the display data in both positive polarity and negative polarity are in the low voltage level, and the DMUXs forward the row data to even data lines, such as the data lines DL_Even1, DL_Even2, and other right-side data line of each column of subpixels. Correspondingly, the DMUX 310_B forwards a scan signal to the scan line SL_Even2 to turn on corresponding transistors to receive the second row data. For the third row data, the display data in both positive polarity and negative polarity are in the high voltage level. Since the third row data is identical to the first row data (i.e., having the same voltage levels) in both positive polarity and negative polarity, the DMUXs select the odd data lines to forward the third row data. For the fourth row data, the display data in both positive polarity and negative polarity are in the low voltage level. Since the fourth row data is identical to the second row data (i.e., having the same voltage levels) in both positive polarity and negative polarity, the DMUXs select the even data lines to forward the fourth row data.

Figure 1:
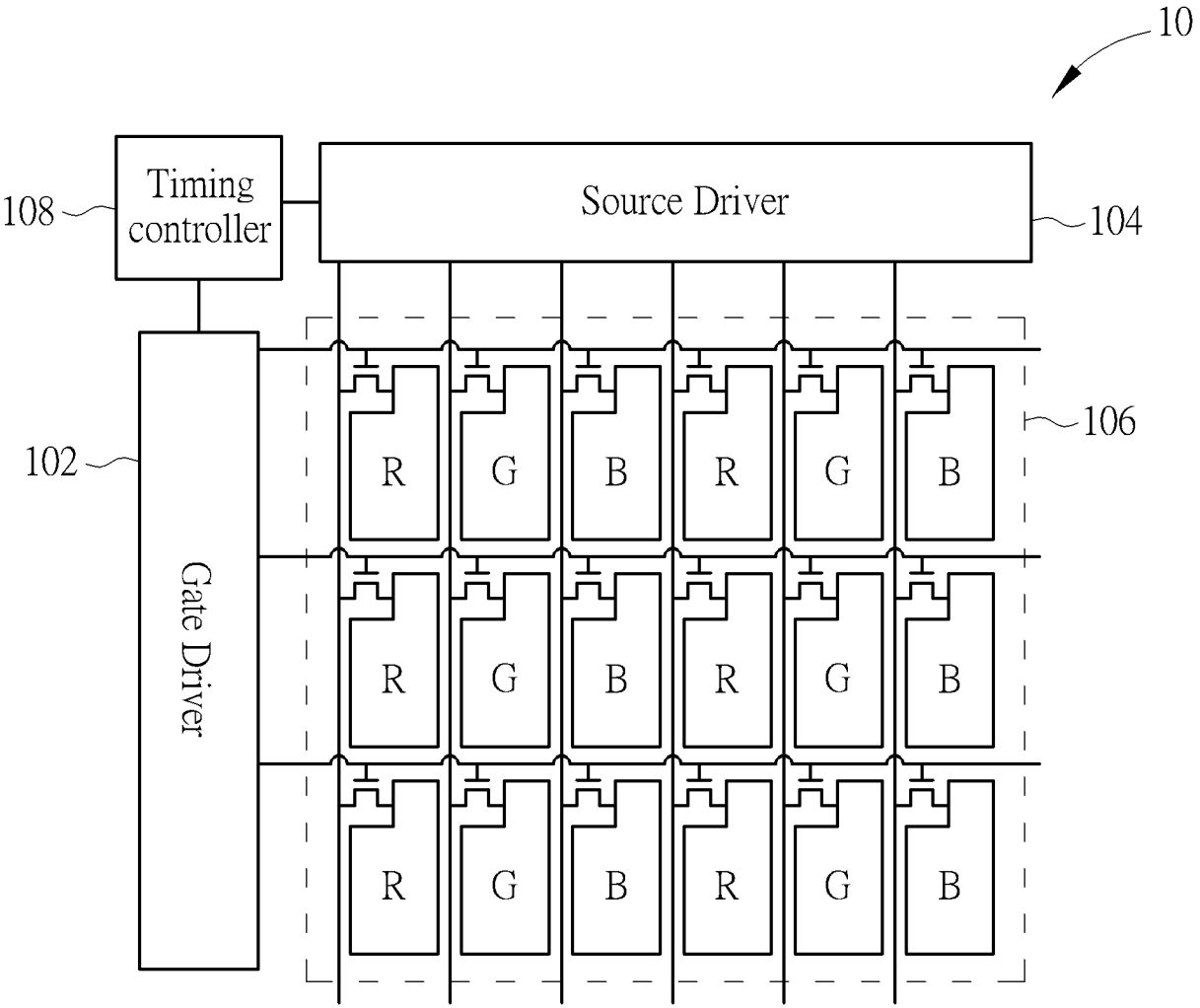
FIG. 1 PRIOR ART
FIG. 1 is a schematic diagram of a conventional display system.
Figure 2B:
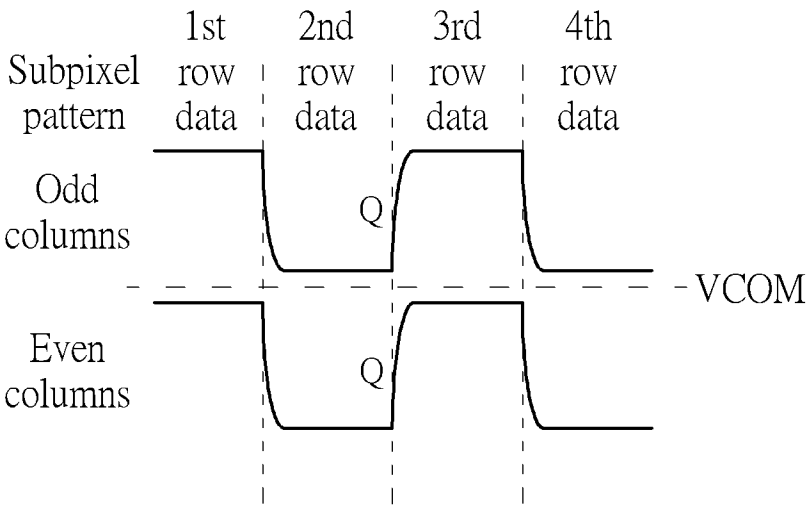
FIG. 2B PRIOR ART
FIGS. 2A and 2B are waveform diagrams of the data lines with heavy-load image patterns.
Figure 6B:
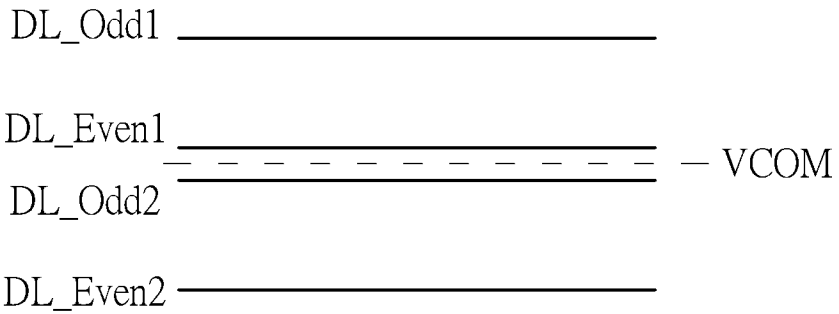
FIG. 6B is a waveform diagram of the data lines with the subpixel pattern.

In this manner, when a row data includes display data with the high voltage level of both positive polarity and negative polarity, the DMUXs are switched to select the odd data lines to forward this row data. When a row data includes display data with the low voltage level of both positive polarity and negative polarity, the DMUXs are switched to select the even data lines to forward this row data. With switching of the DMUXs, each of the odd and even data lines may keep at the same voltage level. Exemplary waveforms of the data lines are illustrated in FIG. 6B, where the data line DL_Odd1 keeps at the high voltage level of positive polarity, the data line DL_Even1 keeps at the low voltage level of positive polarity, the data line DL_Odd2 keeps at the high voltage level of negative polarity, and the data line DL_Even2 keeps at the low voltage level of negative polarity. As a result, with the subpixel pattern, each data line is configured to transmit display data in a specific voltage level, so that the source driver may not need to charge/discharge any of the data lines; hence, power consumption may be significantly reduced in comparison with the display operations of the conventional display panel under the subpixel pattern as shown in FIG. 2B.

Figure 7B:
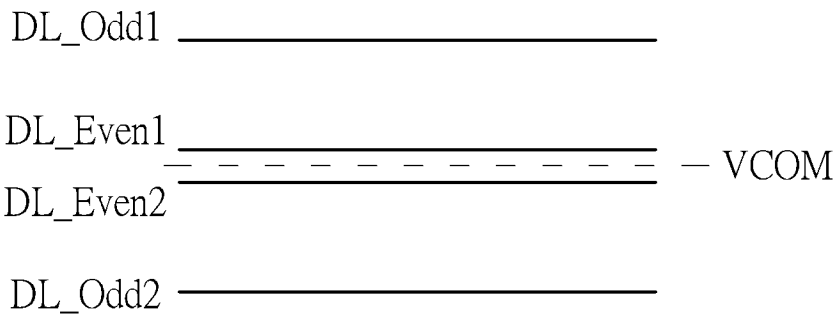
FIG. 7B is a waveform diagram of the data lines with the H-line pattern.
Figure 7A:
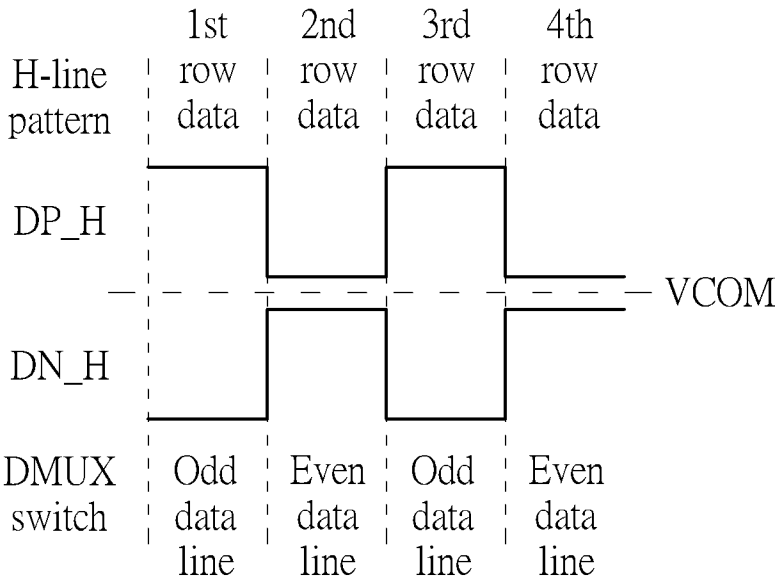
FIG. 7A is a schematic diagram of selection of data lines with display data in the H-line pattern according to an embodiment of the present invention.

FIG. 7A is a schematic diagram of selection of data lines with display data in the H-line pattern according to an embodiment of the present invention. In this embodiment, the display panel is driven with column inversion, where display data with positive polarity DP_H and display data with negative polarity DN_H are transmitted to adjacent columns of subpixels. As shown in FIG. 6B, the display data with positive polarity DP_H keeps switched between a high voltage level of positive polarity and a low voltage level of positive polarity, and the display data with negative polarity DN_H keeps switched between a low voltage level of negative polarity and a high voltage level of negative polarity.

Figure 2A:
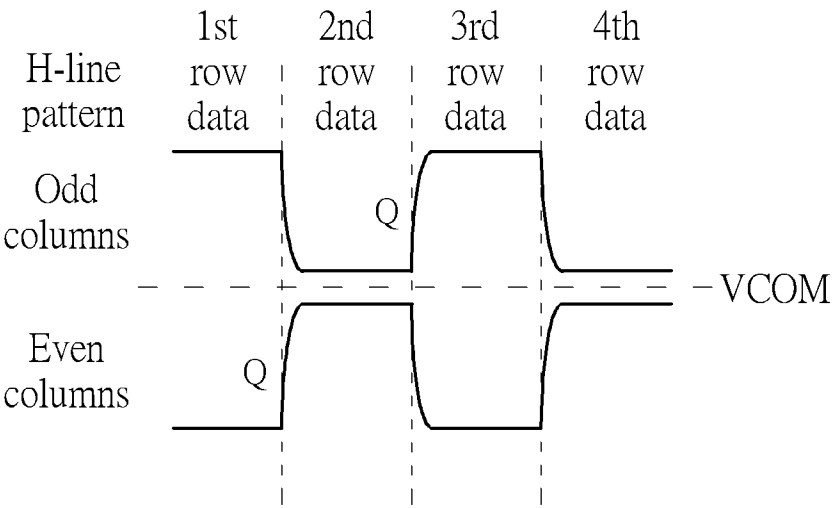
FIG. 2A PRIOR ART

Please refer to FIG. 7A together with the structure of FIGS. 3 and 4, where the H-line image pattern is displayed in the display system 30 or 40. With the H-line pattern shown in FIG. 7A, when a row data includes display data with the high voltage level of positive polarity and the low voltage level of negative polarity (such as the first and third row data), the DMUXs are switched to select the odd data lines to forward this row data. When a row data includes display data with the low voltage level of positive polarity and the high voltage level of negative polarity (such as the second and fourth row data), the DMUXs are switched to select the even data lines to forward this row data. With switching of the DMUXs, each of the odd and even data lines may keep at the same voltage level. Exemplary waveforms of the data lines are illustrated in FIG. 7B, where the data line DL_Odd1 keeps at the high voltage level of positive polarity, the data line DL_Even1 keeps at the low voltage level of positive polarity, the data line DL_Odd2 keeps at the low voltage level of negative polarity, and the data line DL_Even2 keeps at the high voltage level of negative polarity. As a result, with the H-line pattern, each data line is configured to transmit display data in a specific voltage level, so that the source driver may not need to charge/discharge any of the data lines; hence, power consumption may be significantly reduced in comparison with the display operations of the conventional display panel under the H-line pattern as shown in FIG. 2A.

Therefore, if there are only two voltage levels in a sequence of display data, power consumption may be minimized since two data lines of a column of subpixels may keep at two different voltage levels and charging and discharging of data lines are unnecessary. In the frame base examples, the timing controller or the drivers may detect that the upcoming image frame is a test pattern such as the H-line pattern or subpixel pattern, and thereby activate the operations of keeping switching the DMUXs between odd data lines and even data lines. In another embodiment, if the upcoming image frame is determined to partially conform to the test pattern, e.g., more than a half of the image frame is the H-line pattern, the operations of switching DMUXs may also be activated. Even if the image frame is not exactly identical to the test pattern but only a part of the image frame conforms to the test pattern, the operations of switching the DMUXs between different data lines may still reduce the power consumption generated by charging the data lines.

In a further embodiment, the criterion of selecting data lines and scan lines may be performed in line base; that is, the timing controller or the driver may determine that the DMUXs should forward the row data to which lines before each row data is transmitted to the display panel. The determination may be performed based on the voltage levels of the row data and the present voltage levels on the data lines. More specifically, data lines may be selected when the present voltage levels on the data lines are closer to the voltage levels of the upcoming row data.

In an embodiment, a line buffer corresponding to one or more data lines may be included in the timing controller or the driver such as the source driver or the gate driver. The line buffer may store a row data to be forwarded to a data line or the voltage level currently on the corresponding data line. In such a situation, the selection between odd data lines and even data lines may be performed based on the comparison between the upcoming data line and the information stored in the line buffer. For example, the data line selection may be performed based on variations between the upcoming data line and the data line stored in the line buffer. In an embodiment where the DMUXs select to forward row data to odd data lines or even data lines, there may be an odd line buffer and an even line buffer for storing the row data or voltage levels on the odd data lines and the even data lines, respectively.

Figure 8:
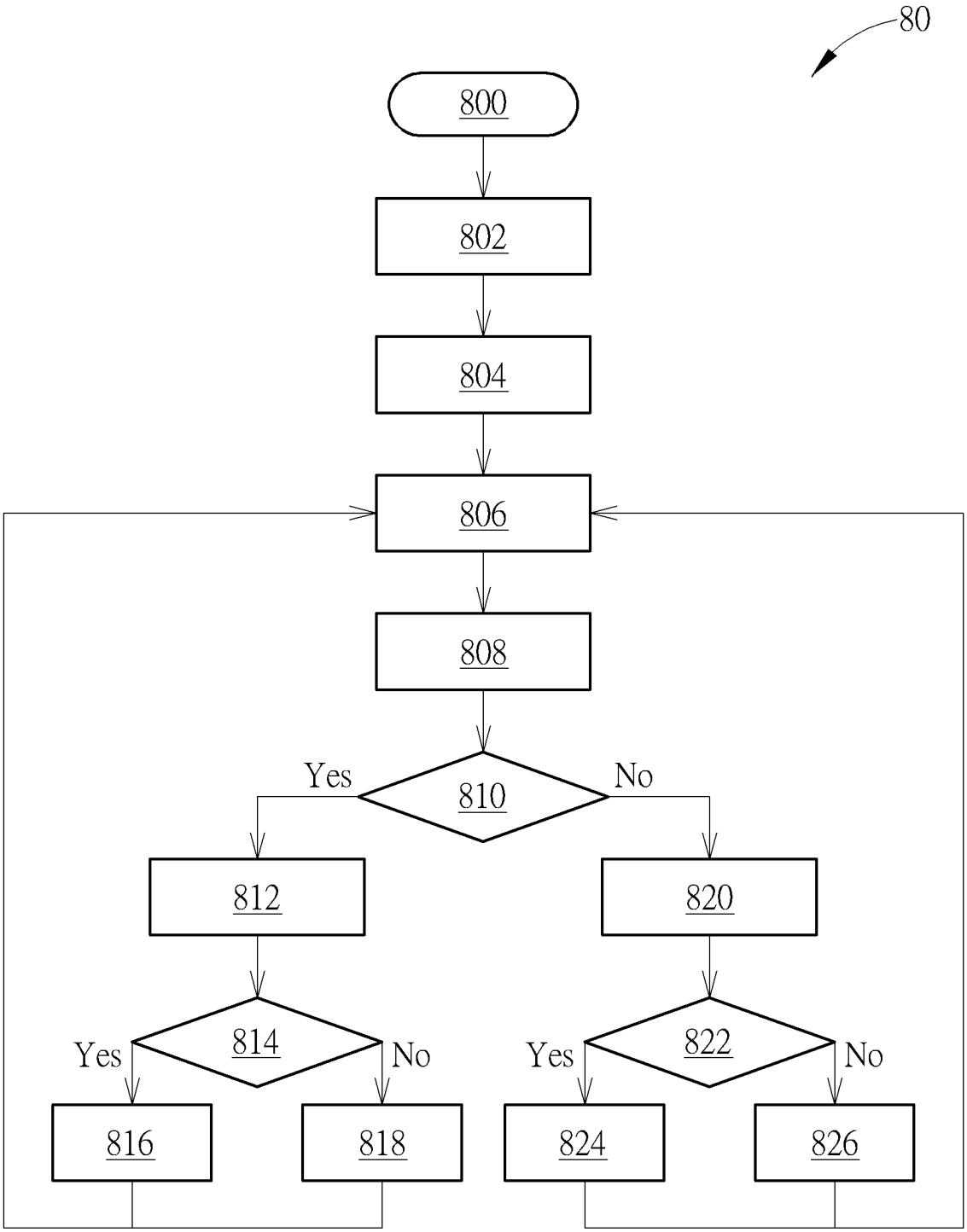
FIG. 8 is a flow chart of a process according to an embodiment of the present invention.

Please refer to FIG. 8, which is a flow chart of a process 80 according to an embodiment of the present invention. The process 80 may be implemented for a display panel, such as the display panel 306 shown in FIG. 3 or the display panel 406 shown in FIG. 4, where the display panel is coupled to a plurality of source drivers and the data line selection is performed based on data variations corresponding to one of the source drivers. As shown in FIG. 8, the process 80 includes the following steps:

Step 800: Start.

Step 802: Pre-charge even data lines to a default voltage level, and store the voltage level in an even line buffer.

Step 804: Forward a first row data to odd data lines to display the first row data on the display panel, and store the first row data in an odd line buffer.

Step 806: Determine the first variation between an upcoming row data and the row data in the odd line buffer and the second variation between the upcoming row data and the row data in the even line buffer corresponding to each respective source driver.

Step 808: Calculate the difference between the first variation and the second variation corresponding to each of the source drivers.

Step 810: Determine whether there are more than two source drivers having the maximum difference. If yes, go to Step 812; otherwise, go to Step 820.

Step 812: Select a first source driver among the source drivers having the maximum difference as the basis of selecting the data lines, where the first source driver is not selected as the basis of data line selection for the previous row data.

Step 814: Determine whether the second variation is greater than the first variation corresponding to the first source driver. If yes, go to Step 816; otherwise, go to Step 818.

Step 816: Select to forward the upcoming row data to the odd data lines to display the upcoming row data, and update the odd line buffer to store the upcoming row data. Then go to Step 806.

Step 818: Select to forward the upcoming row data to the even data lines to display the upcoming row data, and update the even line buffer to store the upcoming row data. Then go to Step 806.

Step 820: Select a second source driver having the maximum difference as the basis of selecting the data lines.

Step 822: Determine whether the second variation is greater than the first variation corresponding to the second source driver. If yes, go to Step 824; otherwise, go to Step 826.

Step 824: Select to forward the upcoming row data to the odd data lines to display the upcoming row data, and update the odd line buffer to store the upcoming row data. Then go to Step 806.

Step 826: Select to forward the upcoming row data to the even data lines to display the upcoming row data, and update the even line buffer to store the upcoming row data. Then go to Step 806.

According to the process 80, the first row data is forwarded to the odd data lines, while the even data lines are pre-charged to a default gray level such as the middle voltage level. For each row data after the first row data, the DMUXs may select to forward the row data to the odd data lines or even data lines according to the determination result of data variations.

In this embodiment, there are multiple source drivers coupled to the display panel, and each source driver may provide display data for partial columns of subpixels in the display panel. The data variations for each source driver is considered separately; that is, each source driver has a corresponding first variation and a corresponding second variation which are calculated based on the voltage levels on the data lines coupled to the source driver. The timing controller or the source driver may include an odd line buffer for storing the row data (i.e., the voltage levels) currently on the odd data lines and an even line buffer for storing the row data (i.e., the voltage levels) currently on the even data lines. The first variation refers to the variation between the upcoming row data and the row data stored in the odd line buffer, and also refers to the variation between the upcoming row data and the row data currently on the odd data lines. The second variation refers to the variation between the upcoming row data and the row data stored in the even line buffer, and also refers to the variation between the upcoming row data and the row data currently on the even data lines.

Subsequently, the difference between the first variation and the second variation corresponding to each source driver may be calculated, and the differences corresponding to the source drivers are compared. If the difference between the first variation and the second variation corresponding to a second source driver is greater than the difference corresponding to any other source driver, i.e., the second source driver has the maximum difference between the first variation and the second variation, the second source driver may be considered as the basis of selecting the data lines. In such a situation, the row data may be selected according to the determination result obtained based on the data variations in the data lines coupled to the second source driver. If the second variation corresponding to the second source driver is greater than the first variation corresponding to the second source driver, the DMUXs may select to forward the upcoming row data to the odd data lines which may lead to less data variation. If the first variation corresponding to the second source driver is greater than the second variation corresponding to the second source driver, the DMUXs may select to forward the upcoming row data to the even data lines which may lead to less data variation.

When the upcoming row data is forwarded to the odd data lines, the odd line buffer, which corresponds to the odd data lines, may be updated to store the upcoming row data. When the upcoming row data is forwarded to the even data lines, the even line buffer, which corresponds to the even data lines, may be updated to store the upcoming row data.

Since the second source driver has the maximum difference between the first variation and the second variation, selecting to forward the row data to the data lines having less data variation may gain more benefits of power reduction due to the larger difference corresponding to the second source driver.

In an embodiment, the determination Step 810 may show that there are more than two source drivers having the maximum difference. In such a situation, one of the source drivers having the maximum difference may be selected as the basis of selecting the data lines. In order to prevent the same source driver from being continuously selected as the basis of data line selection, different source drivers may be selected for two consecutive row data. Therefore, a first source driver among the source drivers having the maximum difference may be selected as the basis of selecting the data lines if the first source driver is not selected as the basis of data line selection for the previous row data. If there are more than two source drivers having large and similar differences of data variations, it is preferable to select different source drivers by turns, to achieve a balance between the source drivers.

In another embodiment, the variations between the upcoming row data and the row data stored in the line buffers may be determined based on the entire display panel. In other words, the data variations for each data line of the display panel are accumulated and considered as the basis of data line selection.

Figure 9:
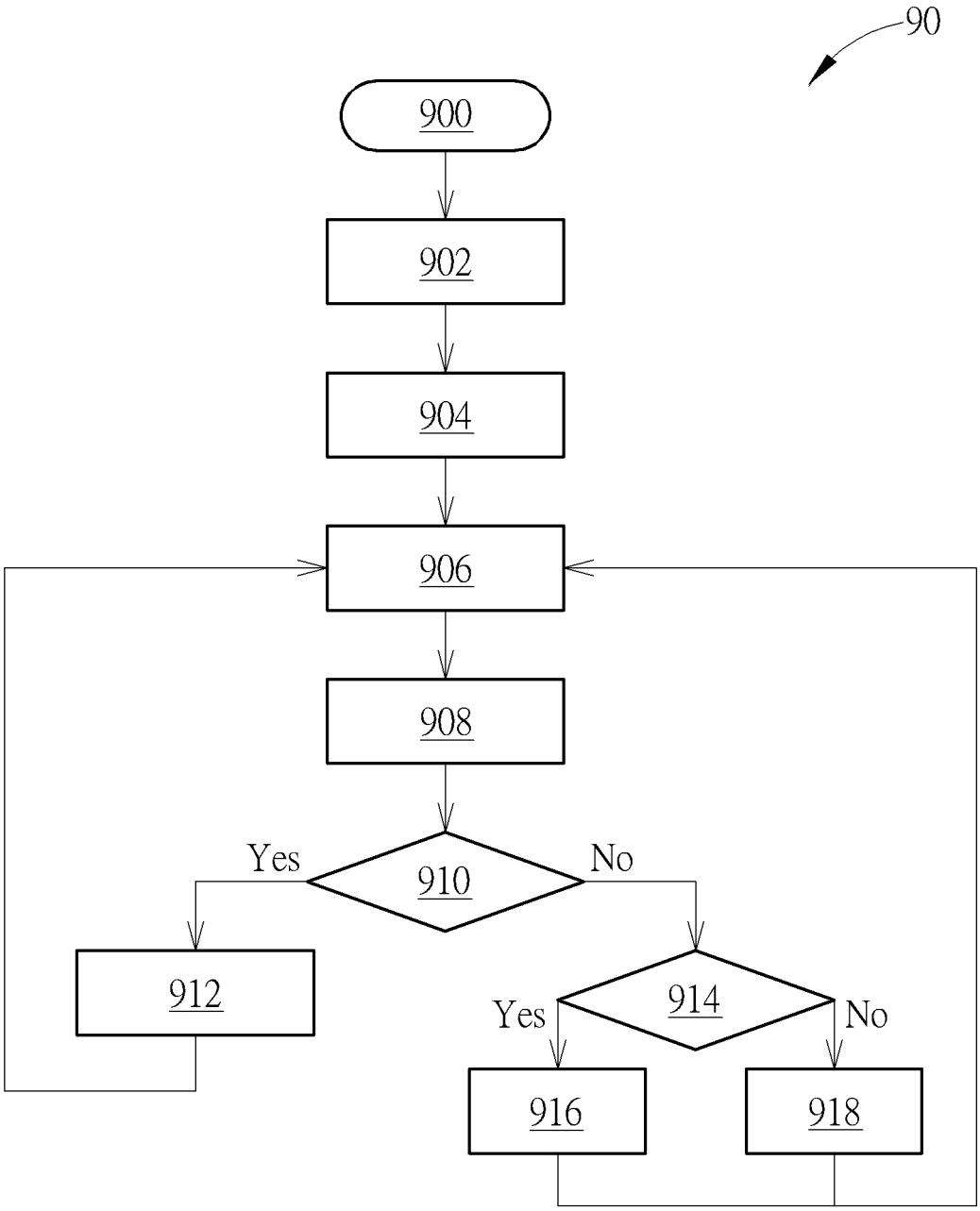
FIG. 9 is a flow chart of a process according to an embodiment of the present invention.

Please refer to FIG. 9, which is a flow chart of a process 90 according to an embodiment of the present invention. The process 90 may be implemented for a display panel, such as the display panel 306 shown in FIG. 3 or the display panel 406 shown in FIG. 4, where the display panel may be coupled to one or more source drivers and the data line selection is performed based on data variations corresponding to the entire display panel. As shown in FIG. 9, the process 90 includes the following steps:

Step 900: Start.

Step 902: Pre-charge even data lines to a default voltage level, and store the voltage level in an even line buffer.

Step 904: Forward a first row data to odd data lines to display the first row data on the display panel, and store the first row data in an odd line buffer.

Step 906: Determine the first variation between an upcoming row data and the row data in the odd line buffer and the second variation between the upcoming row data and the row data in the even line buffer corresponding to the entire display panel.

Step 908: Calculate the difference between the first variation and the second variation.

Step 910: Determine whether the difference is smaller than a threshold. If yes, go to Step 912; otherwise, go to Step 914.

Step 912: Select to forward the upcoming row data to the odd data lines to display the upcoming row data and update the odd line buffer to store the upcoming row data when the row data previous to the upcoming row data is forwarded to the even data lines, or select to forward the upcoming row data to the even data lines to display the upcoming row data and update the even line buffer to store the upcoming row data when the row data previous to the upcoming row data is forwarded to the odd data lines. Then go to Step 906.

Step 914: Determine whether the second variation is greater than the first variation. If yes, go to Step 916; otherwise, go to Step 918.

Step 916: Select to forward the upcoming row data to the odd data lines to display the upcoming row data, and update the odd line buffer to store the upcoming row data. Then go to Step 906.

Step 918: Select to forward the upcoming row data to the even data lines to display the upcoming row data, and update the even line buffer to store the upcoming row data. Then go to Step 906.

The difference between the process 90 and the process 80 is that, in the process 90, the variations between the upcoming row data and the data stored in the line buffers are determined based on the entire display panel rather than based on respective source driver. Therefore, the display panel includes only one first variation and only one second variation, and the data line selection is performed based on the comparison between the first variation and the second variation. Other steps in the process 90 are similar to the related steps in the process 80, which are described in the above paragraphs and omitted herein.

Optionally, the difference between the first variation and the second variation is determined to be smaller than a threshold or not. A small difference means that charging/discharging the odd data lines with the upcoming row data and charging/discharging the even data liens with the upcoming row data may generate similar data variations and probably require equivalent power. Therefore, the odd data lines and the even data lines are both feasible to transmit the upcoming row data. In such a situation, if the row data previous to the upcoming row data is forwarded to the even data lines, the DMUXs may select to forward the upcoming row data to the odd data lines, and the odd line buffer is updated with this upcoming row data. If the row data previous to the upcoming row data is forwarded to the odd data lines, the DMUXs may select to forward the upcoming row data to the even data lines, and the even line buffer is updated with this upcoming row data. Namely, the odd data lines and the even data lines are selected alternately if the difference between the first variation and the second variation is not evident. Note that the threshold for determining the difference may be configured to any value. In an embodiment, the threshold may be configured to 0, and any slight difference between the first variation and the second variation may be considered for data line selection.

Figure 10A:
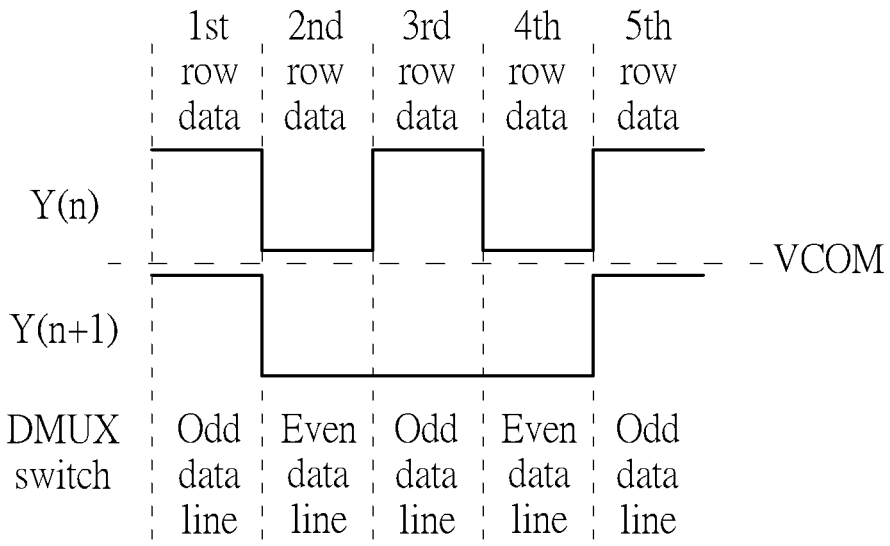
FIG. 10A is a schematic diagram of selection of data lines with exemplary waveforms of row data.

Exemplary waveforms of row data are illustrated in FIG. 10A, where the DMUXs are controlled to select preferable data lines for transmitting the row data. As shown in FIG. 10A, there are two sequence of display data Y(n) and Y(n+1) respectively outputted to two adjacent column of subpixels, such as the first column and the second column of subpixels shown in FIG. 3 or FIG. 4. In this embodiment, the column inversion scheme is applied to encode the display data to drive the data lines, where the display data Y(n) is in positive polarity and the display data Y(n+1) is in negative polarity. The voltage VCOM denotes the common voltage of the display panel.

As shown in FIG. 10A, the DMUXs forward the first row data to the odd data lines, such as the data lines DL_Odd1, DL_Odd2, and other left-side data line of each column of subpixels. In addition, the even data lines, such as the data lines DL_Even1, DL_Even2, and other right-side data line of each column of subpixels, may be pre-charged to a predetermined voltage level such as a medium voltage level. For example, if the voltage levels correspond to data codes ranging from 0 to 255, the even data lines may be pre-charged to a voltage level corresponding to a default gray code 127 before the row data are transmitted to the display panel. In another embodiment, the first row data may be forwarded to the even data lines, and the odd data lines are pre-charged to the predetermined voltage level.

For simplicity, assume that the selection between the odd data lines and even data lines is determined based on the comparison between the upcoming row data and the present voltage data on the data lines of the first column and the second column (i.e., based on the display data Y(n) and Y(n+1) forwarded to the data lines DL_Odd1, DL_Even1, DL_Odd2 and DL_Even2 shown in FIGS. 3 and 4), where the present voltage data on the data lines may also be stored in line buffers for comparison. Those skilled in the art should realize that the display data corresponding to partial or every column may be considered in selection of the data lines.

When the second row data arrives, the DMUXs at the source driver side may forward the second row data to even data lines DL_Even1 and DL_Even2, to display the second row data on the display panel. This is because the second row data (low voltage level in both Y(n) and Y(n+1)) is closer to the voltage level currently on the even data lines DL_Even1 and DL_Even2 than the voltage level currently on the odd data lines DL_Odd1 and DL_Odd2. Note that the voltage level currently on the even data lines DL_Even1 and DL_Even2 is the pre-charged level such as the medium voltage level, and the voltage level currently on the odd data lines DL_Odd1 and DL_Odd2 is the voltage level of the first row data (i.e., high voltage level in both Y(n) and Y(n+1)).

In an embodiment, the timing controller or the driver may determine the variation between the second row data and the first row data currently on the odd data lines (also called the first variation) and the variation between the second row data and the pre-charged voltage level currently on the even data lines (also called the second variation), and then select to display the second row data according to these variations, where the data lines with less variation are selected. In this case, the even data lines DL_Even1 and DL_Even2 are selected and the DMUXs at the source driver side forwards the second row data to the even data lines since the first variation is greater than the second variation. Correspondingly, the DMUXs at the gate driver side may forward the scan signal to turn on the transistors coupled to the even data lines for receiving the second row data.

Subsequently, when the third row data arrives, the DMUXs at the source driver side may forward the third row data to odd data lines, to display the third row data on the display panel. The odd data lines may be selected because less power is required if the third row data (high voltage level in Y(n) and low voltage level in Y(n+1)) is forwarded to the odd data lines, where only the data line DL_Odd2 for transmitting the data Y(n+1) needs to be discharged to low voltage level; hence, no power is consumed due to charging of data lines.

In an embodiment, the timing controller or the driver may determine the variation between the third row data and the first row data currently on the odd data lines (also called the first variation) and the variation between the third row data and the second row data currently on the even data lines (also called the second variation), and then select to display the third row data according to these variations. In this embodiment, the first variation and the second variation are identical. As mentioned above, if the difference between the first variation and the second variation is smaller than a predetermined threshold, each DMUX may be switched to select another data line. Namely, the odd data lines may be selected if the previous row data is forwarded to the even data lines, or the even data lines may be selected if the previous row data is forwarded to the odd data lines. In this embodiment, since the second row data is forwarded to the even data lines, the odd data lines may be selected to forward the third row data. If the difference between the first variation and the second variation is small, it is preferable to apply the odd data lines and the even data lines alternately, to achieve a balance on charging and discharging operations of the data lines.

With similar criteria, the even data lines DL_Even1 and DL_Even2 are selected to forward the fourth row data, since the voltage levels of the fourth row data are identical to the voltage levels of the second row data which are currently on the even data lines DL_Even1 and DL_Even2. The odd data lines DL_Odd1 and DL_Odd2 are selected to forward the fifth row data, since the variation between the fifth row data and the fourth row data (which is currently on the even data lines DL_Even1 and DL_Even2) is greater than the variation between the fifth row data and the third row data (which is currently on the odd data lines DL_Odd1 and DL_Odd2).

Figure 10B:
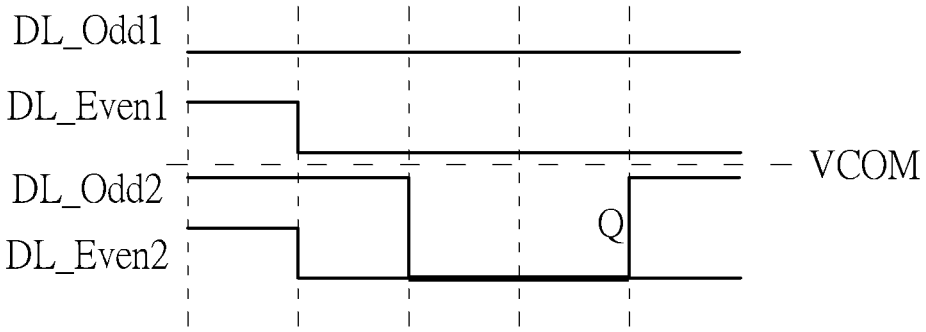
FIG. 10B is a waveform diagram of the data lines in the display panel of the present invention for transmitting the display data shown in FIG. 10A.
Figure 10C:
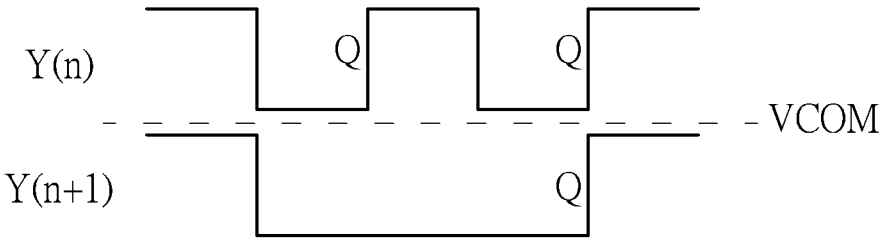
FIG. 10C is a waveform diagram of the data lines in the conventional display panel for transmitting the display data shown in FIG. 10A.

In this embodiment, the waveforms of the data lines DL_Odd1, DL_Even1, DL_Odd2 and DL_Even2 are illustrated in FIG. 10B. As shown in FIG. 10B, under the line base selection scheme with the implementations of the DMUXs, the consumed power quantity is Q generated by charging the odd data line DL_Odd2 from low voltage level to high voltage level due to the fifth row data. In comparison, with the same pattern of display data Y(n) and Y(n+1) in the structure of the conventional display panel, power quantity 3Q is required (2Q for charging with display data Y(n) and 1Q for charging with display data Y(n+1)), as shown in FIG. 10C.

Figure 11A:
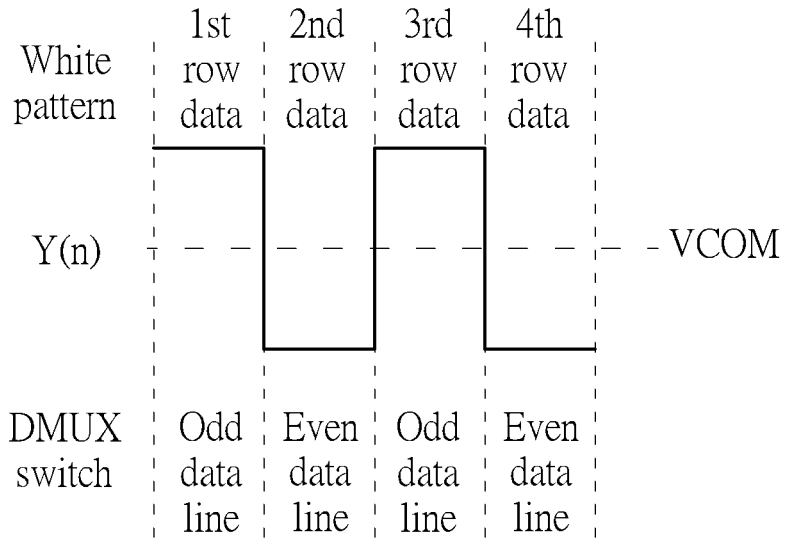
FIG. 11A is a schematic diagram of selection of data lines when the display panel is driven with dot inversion according to an embodiment of the present invention.

In the above embodiments, the display panel is driven with column inversion; in another embodiment, the structure of the display panel having two data lines coupled to each column of subpixels and two scan lines coupled to each row of subpixels and the method of selecting data lines and scan lines via DMUXs are implemented with the dot inversion scheme. Please refer to FIG. 11A, which is a schematic diagram of selection of data lines when the display panel is driven with dot inversion according to an embodiment of the present invention. FIG. 11A illustrates an example of white pattern in a normally black panel, where a sequence of display data Y(n) is switched between high voltage level of positive polarity and low voltage level of negative polarity, both of which correspond to the maximum brightness.

Figure 11B:
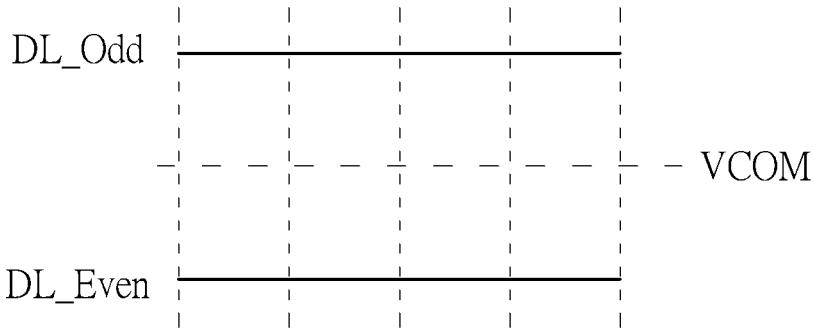
FIG. 11B is a waveform diagram of the data lines in the display panel of the present invention for transmitting the display data shown in FIG. 11A.
Figure 11C:
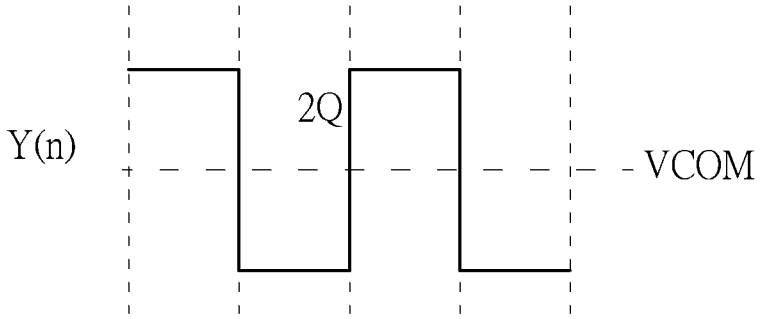
FIG. 11C is a waveform diagram of the data lines in the conventional display panel for transmitting the display data shown in FIG. 11A.

As shown in FIG. 11A, the DMUXs are switched between odd data lines and even data lines. More specifically, a DMUX may forward the row data to an odd data line DL_Odd when the voltage of the display data Y(n) is the high voltage level of positive polarity, and may forward the row data to an even data line DL_Even when the voltage of the display data Y(n) is the low voltage level of negative polarity. FIG. 11B illustrates the waveforms of the data lines DL_Odd and DL_Even for transmitting the display data Y(n) shown in FIG. 11A. As shown in FIG. 11B, the data line DL_Odd keeps at the high voltage level of positive polarity, and the data line DL_Even keeps at the low voltage level of negative polarity. Therefore, no data line needs to be charged or discharged to vary its voltage level, and thus no power is consumed due to data variations. In comparison, with the same pattern of display data Y(n) in the structure of the conventional display panel, power quantity 2Q is required, as shown in FIG. 11C.

In another embodiment, the particular image pattern or the heavy-load image pattern may be implemented with dot inversion scheme. Please refer to FIG. 12A, which is a schematic diagram of selection of data lines with display data in the H-line pattern according to an embodiment of the present invention. With the dot inversion scheme and the H-line pattern, a display data Y(n) is switched between the high voltage level of positive polarity and the high voltage level of negative polarity.

Figure 12A:
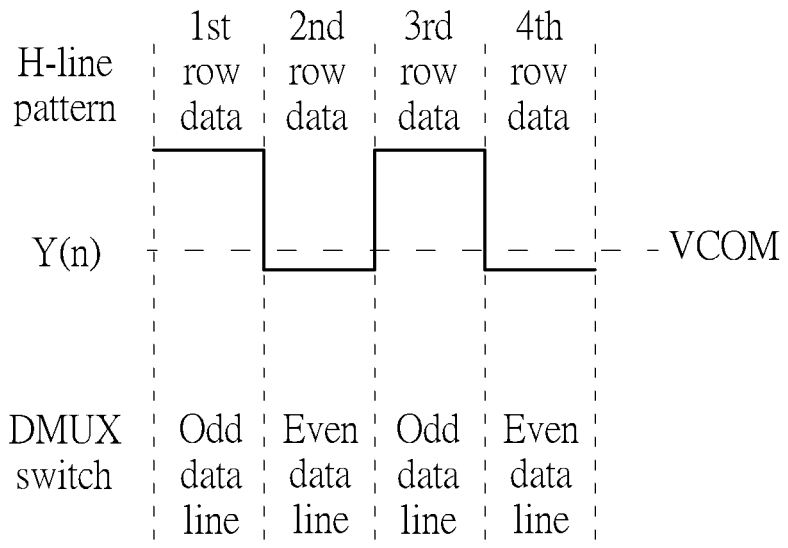
FIG. 12A is a schematic diagram of selection of data lines with display data in the H-line pattern according to an embodiment of the present invention.
Figure 12B:
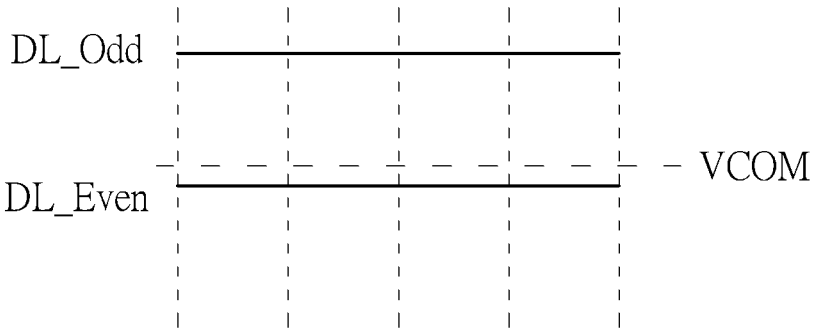
FIG. 12B is a waveform diagram of the data lines in the display panel of the present invention for transmitting the display data shown in FIG. 12A.
Figure 12C:
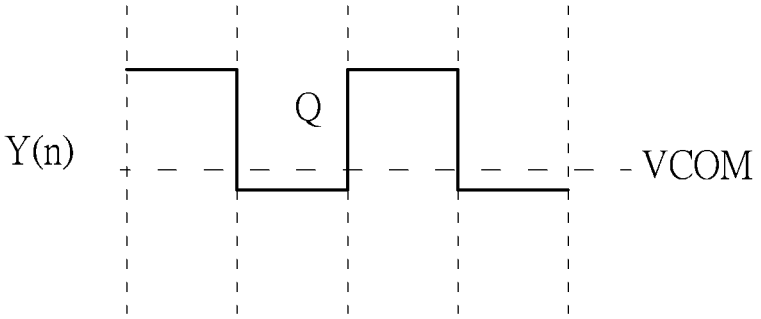
FIG. 12C is a waveform diagram of the data lines in the conventional display panel for transmitting the display data shown in FIG. 12A.

As shown in FIG. 12A, the DMUXs are switched between odd data lines and even data lines. More specifically, a DMUX may forward the row data to an odd data line DL_Odd when the voltage of the display data Y(n) is the high voltage level of positive polarity, and may forward the row data to an even data line DL_Even when the voltage of the display data Y(n) is the high voltage level of negative polarity. FIG. 12B illustrates the waveforms of the data lines DL_Odd and DL_Even for transmitting the display data Y(n) shown in FIG. 12A. As shown in FIG. 12B, the data line DL_Odd keeps at the high voltage level of positive polarity, and the data line DL_Even keeps at the high voltage level of negative polarity. Therefore, no data line needs to be charged or discharged to vary its voltage level, and thus no power is consumed due to data variations. In comparison, with the same pattern of display data Y(n) in the structure of the conventional display panel, power quantity Q is required, as shown in FIG. 12C.

It should be noted that the abovementioned criteria of frame base or line base methods for selecting data lines are exemplary embodiments of the present invention. Any other criteria or algorithms of data line selection applicable to the structure of the display panel (with double data lines and scan lines) are also included in the scope of the present invention.

Please note that the present invention aims at providing a novel structure of a display panel with two data lines coupled to each column of subpixels and two scan lines coupled to each row of subpixels, where a plurality of DMUXs are applied to select odd or even data lines for transmitting row data and select the corresponding scan lines for transmitting scan signals. Those skilled in the art may make modifications and alternations accordingly. For example, in the above embodiments, there are two data lines coupled to each column of subpixels, where each row data is selected to be forwarded to the odd data lines or even data lines among these data lines. In another embodiment, there may be more than two data lines coupled to each column of subpixels and each DMUX may select to forward display data to one of the data lines. Correspondingly, there are more than two scan lines coupled to each row of subpixels and more than two transistors each corresponding to a scan line. For example, in an embodiment, each column of subpixels is coupled to three data lines. The timing controller or the driver may select a data line from the three data lines, and control the DMUX at the source driver side to forward a display data to the selected data line. Correspondingly, a DMUX at the gate driver side may forward the scan signal to a selected scan line among three scan lines, to turn on one of three transistors for receiving the display data.

Figure 13:
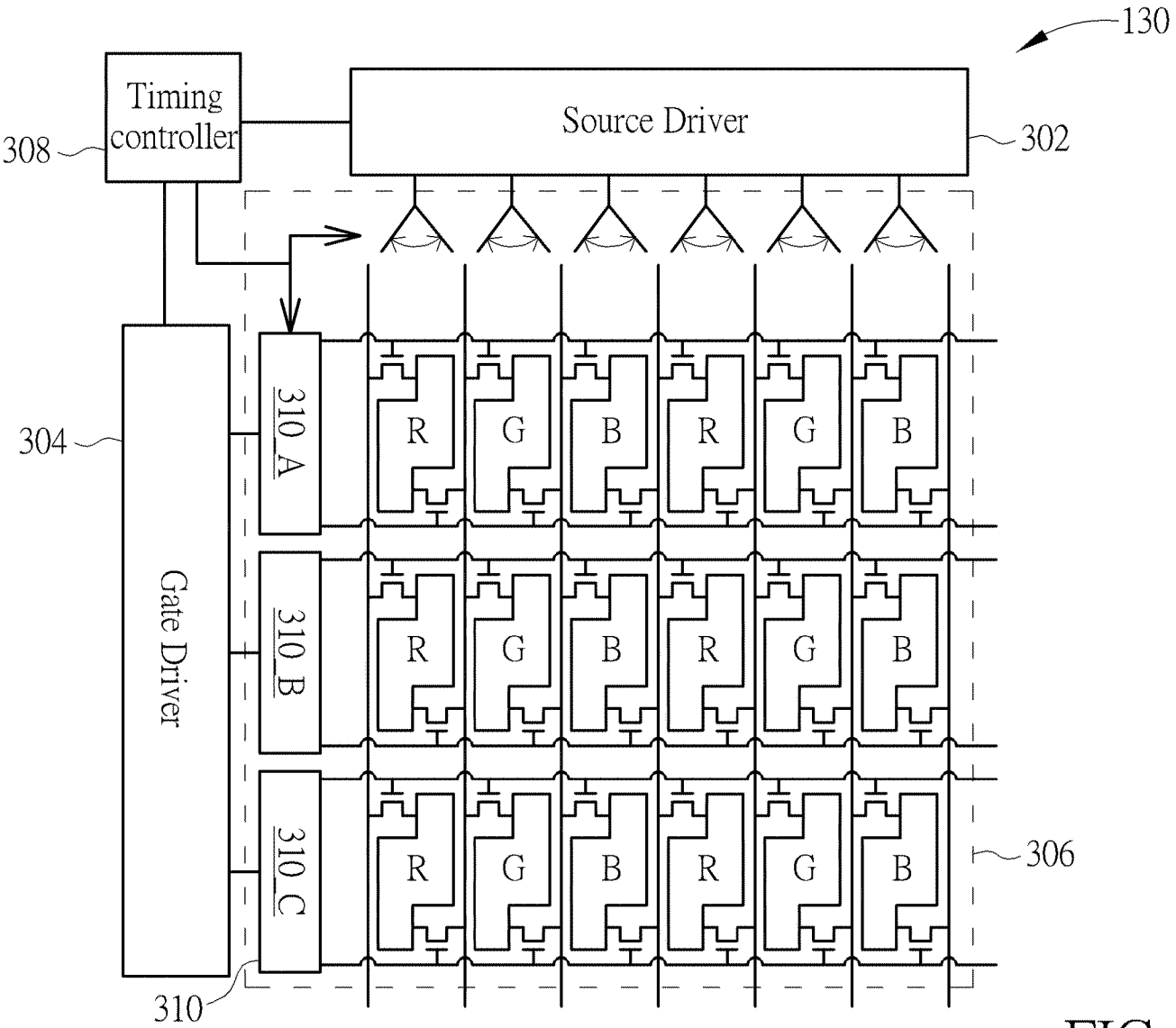
FIG. 13 is a schematic diagram of a display system according to an embodiment of the present invention.

In an embodiment, the deployment of DMUXs may be replaced by switches. For example, please refer to FIG. 13, which is a schematic diagram of a display system 130 according to an embodiment of the present invention. The structure of the display system 130 is similar to the structure of the display system 30, so the signals and elements with similar functions are denoted by the same symbols. The difference between the display system 130 and the display system 30 is that, the display system 130 does not include the DMUXs at the source driver side. Instead, there are switches coupled between the data lines and the output pads of the source driver. In the display system 130, each column of subpixels is coupled to two adjacent data lines. Each data line is shared by two adjacent columns of subpixels, except the leftmost and the rightmost data lines. Each switch is selected to be coupled between the source driver and one of two adjacent data lines, for forwarding a display data to one of the two adjacent data lines.

For a heavy-load image frame with display data switched between two different voltage levels, each switch may forward a voltage level to the data line at its left-hand side and forward another voltage level to the data line at its right-hand side. The waveforms of the data lines in the display system 130 may be similar to the waveforms shown in FIG. 11B, where no data lines require to be charged or discharged due to data variations. The implementations and operations may significantly reduce power consumption for the heavy-load image frame. Also, in comparison with other embodiments having DMUXs at the source driver side, the display panel 306 of the display system 130 includes fewer data lines. This reduces the cost of the display panel 306 and also facilitates the layout of the display panel 306.

To sum up, the present invention provides a novel structure of a display panel with two data lines coupled to each column of subpixels and two scan lines coupled to each row of subpixels. The DMUXs or switches at the source driver side may select to forward the display data to the odd data lines or even data lines. The DMUXs at the gate driver side forward the scan signals to corresponding transistors, allowing each column of subpixels to receive the display data from the selected data lines. The DMUXs may be implemented in the display panel or the drivers. The criterion of selecting to forward the display data to the odd data lines or the even data lines may be implemented with frame base or line base. In the frame base scheme, the timing controller or the driver may determine whether a frame of display data partially or entirely conforms to a particular image pattern. If the frame of display data conforms to a particular image pattern such or a heavy-load image pattern as the H-line pattern or subpixel pattern, the DMUXs are switched to forward row data to odd data lines and even data lines alternately. This reduces power consumption significantly because no data line needs to be charged or discharged due to data variations. In the line base scheme, the timing controller or the driver may determine that the DMUXs should forward each row data to which lines before the row data is transmitted to the display panel. Power reduction is achieved if the selected data lines have smaller data variations with the upcoming row data. Therefore, the embodiments of the present invention lead to significant reduction of power consumption, especially for the heavy-load image pattern, and the problem of failing to charge a data line to its target level may also be solved since the data lines corresponding to smaller data variations are selected.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display panel, comprising:

a plurality of data lines;

a plurality of scan lines;

a plurality of subpixels, each coupled to at least two of the plurality of data lines and at least two of the plurality of scan lines;

a plurality of first demultiplexers, each coupled to at least two of the plurality of scan lines; and a plurality of second demultiplexers, each coupled to at least two of the plurality of data lines;

wherein each of the plurality of subpixels is coupled to one of the plurality of second demultiplexers via each of the at least two data lines;

wherein one of the plurality of subpixels is coupled to a first data line and a second data line among the plurality of data lines, and one of the plurality of second demultiplexers, which is coupled to the first data line and the second data line, selects to forward a display data to one of the first data line and the second data line according to a difference between the first display data and a present data in the first data line and a difference between the first display data and a present data in the second data line.

2. The display panel of claim 1, wherein one of the plurality of subpixels is coupled to a first scan line and a second scan line among the plurality of scan lines, and one of the plurality of first demultiplexers, which is coupled to the first scan line and the second scan line, selects to forward a scan signal to one of the first scan line and the second scan line.

3. The display panel of claim 1, further comprising:

a plurality of switches, each coupled between a source driver and one of the plurality of data lines.

4. The display panel of claim 3, wherein one of the plurality of switches selects to be coupled to one of a first data line and a second data line among the plurality of data lines, for forwarding a display data to one of the first data line and the second data line.

5. The display panel of claim 1, wherein each of the plurality of subpixels comprises at least two transistors coupled to different data lines among the plurality of data lines and different scan lines among the plurality of scan lines.

6. A source driver for a display panel, the source driver comprising a plurality of data output channels, each data output channel comprising:

an output buffer;

at least two output pads, coupled to a line of subpixels in the display panel; and a demultiplexer, coupled between the output buffer and the at least two output pads;

wherein the demultiplexer is coupled to each subpixel among the line of subpixels via each of the at least two output pads;

wherein the at least two output pads comprise a first output pad and a second output pad respectively coupled to a first data line and a second data line of the display panel, one of the plurality of data output channels is coupled to the first output pad and the second output pad, and the demultiplexer of the data output channel selects to forward a display data to one of the first output pad and the second output pad according to a difference between the first display data and a present data in the first data line and a difference between the first display data and a present data in the second data line.

7. The source driver of claim 6, wherein each data output channel further comprises:

a digital to analog converter (DAC), coupled to the output buffer;

a level shifter, coupled to the DAC;

a data register, coupled to the level shifter;

a shift register, coupled to the data register; and a receiver, coupled to the shift register.

8. A method of driving a subpixel of a display panel, the subpixel coupled to at least one lines of the display panel having a first line and a second line, the method comprising:

forwarding a first row data to the first line to display the first row data on the display panel;

forwarding a second row data to the second line to display the second row data on the display panel;

determining a first variation between a third row data and the first row data and a second variation between the third row data and the second row data, to generate a determination result; and selecting to forward the third row data to the first line or the second line according to the determination result, to display the third row data on the display panel.

9. The method of claim 8, wherein the step of selecting to forward the third row data to the first line or the second line according to the determination result comprises:

selecting to forward the third row data to the first line when the second variation is greater than the first variation; and selecting to forward the third row data to the second line when the first variation is greater than the second variation.

10. The method of claim 8, further comprising:

calculating a difference between the first variation and the second variation; and when the difference is smaller than a threshold, performing one of the following steps:

selecting to forward the third row data to the first line when a row data previous to the third row data is forwarded to the second line; and selecting to forward the third row data to the second line when the row data previous to the third row data is forwarded to the first line.

11. The method of claim 8, further comprising:

pre-charging the first line or the second line to a default voltage level before transmitting the row data to the display panel.

12. The method of claim 8, further comprising:

determining whether a frame of display data conforms to a particular image pattern.

13. The method of claim 12, wherein the particular image pattern is a subpixel pattern or an H-line pattern.

14. The method of claim 8, wherein the step of determining a first variation between a third row data and the first row data and a second variation between the third row data and the second row data comprises:

determining the first variation and the second variation corresponding to the entire display panel.

15. The method of claim 8, wherein the display panel is coupled to a plurality of source drivers, and the step of determining a first variation between a third row data and the first row data and a second variation between the third row data and the second row data comprises:

determining the first variation and the second variation corresponding to each of the plurality of source drivers.

16. The method of claim 15, further comprising:

calculating a difference between the first variation and the second variation corresponding to each of the plurality of source drivers;

selecting to forward the third row data to the first line or the second line according to the determination result generated based on the first variation and the second variation corresponding to a first source driver among the plurality of source drivers;

wherein the difference corresponding to the first source driver is greater than the difference corresponding to any other source driver among the plurality of source drivers.

* * * * *